US011098469B2

(12) United States Patent
Orsano et al.

(10) Patent No.: US 11,098,469 B2
(45) Date of Patent: Aug. 24, 2021

(54) ADJUSTABLE SPACER BETWEEN TOILET AND WALL

(71) Applicants: Anthony Orsano, Williston Park, NY (US); George Samouhos, Garfield, NJ (US)

(72) Inventors: Anthony Orsano, Williston Park, NY (US); George Samouhos, Garfield, NJ (US)

( * ) Notice: Subject to any disclaimer, the term of this patent is extended or adjusted under 35 U.S.C. 154(b) by 36 days.

(21) Appl. No.: 16/550,778

(22) Filed: Aug. 26, 2019

(65) Prior Publication Data

US 2019/0376268 A1 Dec. 12, 2019

Related U.S. Application Data

(60) Division of application No. 15/688,991, filed on Aug. 29, 2017, now Pat. No. 10,435,879, which is a continuation-in-part of application No. 14/014,544, filed on Aug. 30, 2013, now abandoned.

(51) Int. Cl.

| | |
|---|---|
| ***E03D 1/012*** | (2006.01) |
| ***E03D 11/14*** | (2006.01) |
| ***A47K 17/02*** | (2006.01) |
| *E03D 11/02* | (2006.01) |

(52) U.S. Cl.

CPC ..... *E03D 11/14* (2013.01); *A47K 17/02* (2013.01); *E03D 11/02* (2013.01)

(58) Field of Classification Search

CPC ..... A47B 95/043; A47B 95/00; A47B 95/008; A47B 97/00; A47C 7/002; E03D 1/00; E03D 1/01; E03D 11/00; E03D 311/135; E03D 11/14–146; E03D 11/02; Y10T 29/49947; Y10T 29/49948; Y10T 29/49963; F16B 5/0635; F16M 13/02

See application file for complete search history.

(56) References Cited

U.S. PATENT DOCUMENTS

| | | | | | |
|---|---|---|---|---|---|
| 2,810,136 | A * | 10/1957 | Kearney | E03D 1/26 | 4/419 |
| 3,666,225 | A * | 5/1972 | Weinberger | E03D 1/01 | 248/205.3 |
| 5,997,412 | A * | 12/1999 | Benson | A63B 53/00 | 473/296 |
| 6,073,899 | A * | 6/2000 | Omrani | A47K 10/185 | 248/311.2 |
| 2015/0191902 | A1* | 7/2015 | Vadnais | F16B 5/0635 | 29/428 |

* cited by examiner

*Primary Examiner* — Jun S Yoo
(74) *Attorney, Agent, or Firm* — Michael J. Feigin, Esq.; Feigin and Fridman LLC

(57) ABSTRACT

An adjustable spacer device for use in the space between a toilet and a wall and a method installing same is disclosed. The device includes a component module formed prior to installation within the wall space where it is then finally adjusted to fit within the wall space and to maintain a set separation distance between the toilet and the wall. The adjustable spacer device includes a cover that further stabilizes and secures the component module.

8 Claims, 11 Drawing Sheets

ADJUSTABLE SPACER BETWEEN TOILET AND WALL

CROSS REFERENCE TO RELATED APPLICATIONS

This application is related to and claims the benefit of currently pending U.S. patent application Ser. No. 14/014,544, filed Aug. 30, 2013, the disclosures of which is incorporated herein by reference in its entirety.

FIELD OF THE INVENTION

The disclosed technology relates generally to a spacing and stabilizing device and method of installation configured to maintain the spacing between a toilet and a wall.

BACKGROUND OF THE INVENTION

Above-ground toilets with bowls are typically spaced next to, but not touching, a wall. Typical porcelain toilets with high backs, as commonly found around the world, have drawbacks, in that the long narrow backs rise above the base of the toilet and are susceptible to shearing forces or forces transverse to the rise of the back of the toilet. This occurs simply when a person leans on the toilet to sit down or rise, or when leaning on the toilet for another reason. The result, if does not occur right away, then over time it may result in a leaky toilet, or potentially worse—a cracked toilet. Simply pushing on a toilet (the higher up from the ground, the greater the fulcrum) causes seals, such as those which utilize rubber washers, to open and the toilet to move. Over time, fissures or cracks can develop, and the toilet itself may leak, the seal between the toilet and ground may leak, or the toilet tank may even break away from the toilet bowl.

In public rest rooms, toilets are often designed without a high tank, instead relying on high water pressure; but even so, this set-up has other disadvantages, such as more expensive water systems and less aesthetic toilets. The problem is further exacerbated during renovations, for the simple reason that the positioning of toilets (cut-in holes) tends to vary. For example, in the United States, toilets previously were set 14 inches on center off the wall. Currently, they are set 12 inches on center off the wall. When installing a new toilet designed for the smaller distance, this leaves two extra inches between the wall and toilet, causing the above-mentioned problems of shear forces when pressure is applied on the tank of the toilet.

The disclosed invention provides a module which is preassembled prior to positioning/installation in the space between the toilet and the wall. Upon insertion into such space, a final adjustment is made in the longitudinal direction through rotation of the extension fastener(s), so that in the final position the module is tightly fit between the toilet tank and the wall. Once in final position, the flat surfaces of the extension fastener(s) and other module elements are aligned to form a continuous formation having a hexagonal, square or similarly shaped exterior and further secured and stabilized by a cover.

To resolve the issues of the prior art, the present invention provides a stabilization device and a method of installation thereof, which stabilizes the toilet tank, preventing movement that causes leakage and protecting against damage to the wall behind the toilet. The novel stabilization device and method is easy to install, cost effective and aesthetically pleasing.

SUMMARY OF THE INVENTION

An adjustable spacer device including a cover and method of installing same represent an essential aspect of the disclosed technology. The device includes an elongated toilet tank plate with a threaded member affixed thereto, a wall piece, and at least one extension fastener. A module is formed comprising a wall piece and at least one extension fastener. The module may also include toilet tank plate. Prior to installation, the module is loosely assembled, so that each piece is connected to another by the threading. Once assembled, the module fits into the limited space between the wall and the toilet tank. After being properly positioned within the space, through adjustment/rotation of the extension fastener (s) or bolt(s) ("fastener" and "bolt," are terms known in the art and are used interchangeably in this disclosure), a final longitudinal adjustment is provided. Upon completion of the final longitudinal adjustment, the module is tightly positioned within the space, preventing any undesirable motion of the toilet tank relative to the wall.

One of the essential features of the present invention revolves around the step of adjustment, with at least one extension fastener being rotated (either to extend or retract) forming the final position of the module, wherein continuous flat surfaces including the exteriors of all multifaceted elements of the module are developed. At such final position, the flat exterior surfaces of the multi-faceted elements are aligned having the same longitudinal orientation, forming a continuous formation.

An alternative embodiment includes the toilet tank plate having a threaded bolt instead of a nut shaped formation. In this embodiment, the module elements appear inverse to the first embodiment. Further neither embodiment is limited to a square shaped exterior. Other interconnecting shapes such as a hexagonal (6 facet) exterior or similar are envisioned so long as the when the final adjustment is completed, all elements of the module are aligned to form a continuous formation along the longitudinal axis.

Another novel feature of the present invention is the cover which sits atop or designed to engage the exterior of the assembled module and/or other elements, after the spacer device and or the module are in the final adjusted position within the space between the wall and the toilet tank. The inner surface of the cover is formed with at least two flat surfaces provided to engage the exterior flat surfaces of the multifaceted elements of the module and other elements of the device. The cover is composed of resilient material having a longitudinal slit.

During installation, the cover in positioned over the preassembled module through the slit, so that the cover snaps or tightly fits over the module assembly exterior. In the finally assembled position, the inner flat surfaces of the cover engage the exterior flat surfaces of the module elements, stabilizing and retaining the continuous formation. In addition to the aesthetically pleasing nature, the cover also importantly serves to retain and stabilize the adjusted positions of the module elements and the entire device, thereby retaining alignment of the continuous formation. The cover can be formed as one unitary member, or can be formed by multiple breakaway sections to facilitate installation and provide flexibility to conform to varied lengths of the final module/assembly.

DETAILED DESCRIPTION OF THE INVENTION

Figure 1:
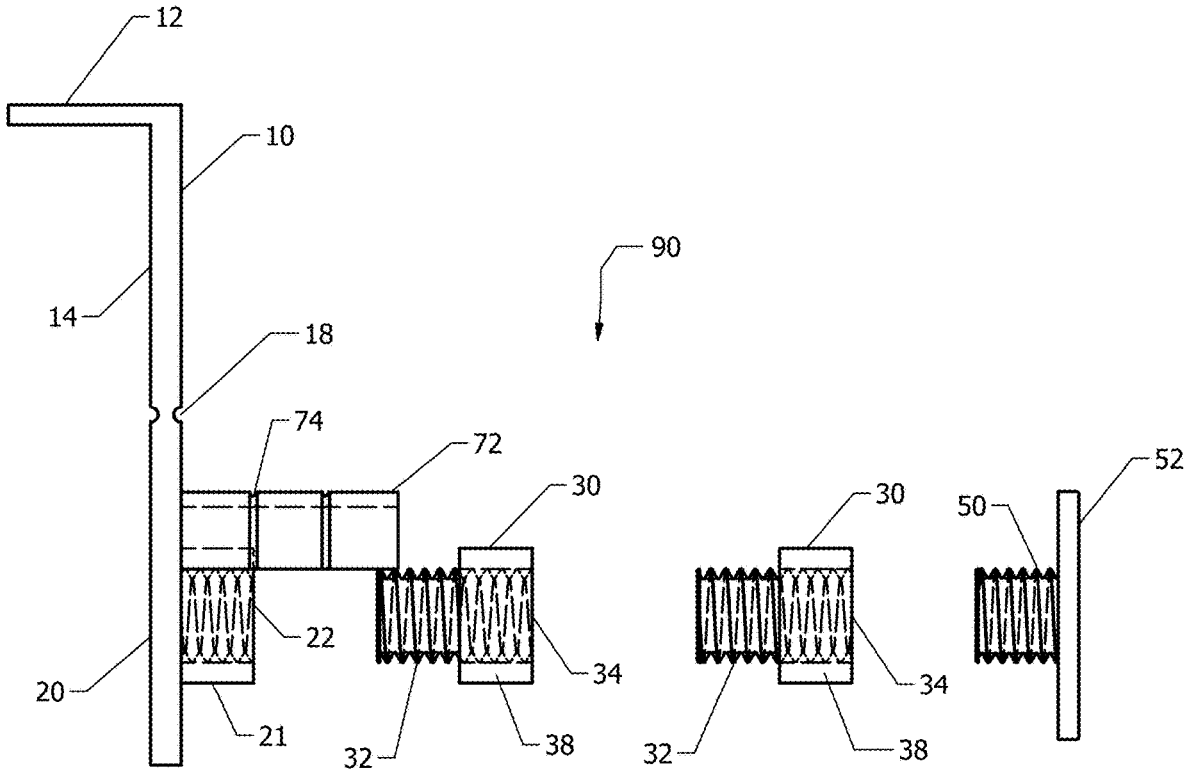
FIG. 1 is an exploded side elevational view of an adjustable spacer device of an embodiment of the disclosed technology.

An adjustable spacer device 90 of the preferred embodiment of the disclosed technology has an elongated toilet plate 10. This plate 10 is formed having a unitary upper portion 14 and lower portion 20 connected by a breakaway joint 18. A toilet insert 12 is connected to, and non-obtusely angled from the upper portion of the elongated toilet plate in embodiments of the disclosed technology. A generally flat wall plate 52, connected to the adjustable length extension mechanism, is in parallel to the elongated side of the toilet plate 10. The adjustment mechanism includes at least one extension fastener 30 with a female threaded cavity 34 and male threaded region 32. The lower portion 20 of the elongated toilet plate 10 may have either female threads (see FIGS. 1-3) or male threads (see FIG. 9). In the assembled position, a toilet plate 10 interconnecting portion 21 with integrated threads 22 (either female or male threads) may form a unitary structure with the wall plate 52. The extension fastener(s) 30 are loosely assembled together through the threading 50 with the wall piece 52 prior to installation in the space 60 between the toilet tank and the wall 80 in the formation of a module 70. Once the module is inserted within the wall space 60 and properly positioned, a longitudinal adjustment is taken place. This is needed to assure tight positioning of the spacer device 90 within the wall space 60 and to prevent any further motion of the component pieces, while a continuous unitary aligned structure/module 70 is formed.

Embodiments of the disclosed technology will become more obvious in view of the following description of the figures.

FIG. 1 shows an exploded plan view of an adjustable spacer device 90 of one embodiment of the disclosed technology. The toilet plate 10 has an upper portion 14 and lower portion 20 attached via a breakaway joint 18, which is thinner, bendable, and breakable. The breakaway joint 18 allows one to bend the upper portion 14 with respect to the lower portion 20 to angle the upper portion and toilet insert 12 as necessary for an angled toilet. Further, one may simply break the upper portion 14 from the lower portion 20 if a spacer is needed without the upper portion 14 and toilet insert 12. The lower portion 20 can then be optionally adhered or secured by pressure to the rear wall of the toilet tank for support. In order to adhere the spacer 90, an adhesive with a peel back protective cover 54, 56, respectively, is applied to the wall plate 52 and/or the interior surface of the lower portion 20.

The toilet insert 12 (as seen in use in FIGS. 5-8) is placed between a lid of a toilet 62 (covering the toilet tank) and the body of the tank 64. Toilet tanks 64 and lids 62 are known in the art. The insert 12 is a thin extension of the toilet plate 10. The insert is attached curvilinearly or perpendicularly to the upper portion 14 at a right or acute angle thereto. The lower portion 20 via the breakaway joint 18 is removably or unitary attached to the portion 14.

As illustrated in FIG. 1, the lower portion 20 of the toilet plate 10 has an interconnecting portion 21 with integrated internal/female threads 22. In another embodiment a male, external threading 21 can be also provided (see FIG. 9). By the threads 22 one can screw or attach any reasonable number of extension fasteners 30 to fill the space 60 between the toilet 66 and the wall 80. In FIGS. 1-4 two extension fasteners 30 are shown with respective male threads 32 and female threads 34. The threads 22 of the portion 21 (or toilet plate) are rotatably attached to/within the head of the next fastener 30 via the female threaded cavity 34 formed within the respective head 38. For example, threads 22 of the interconnecting portion 21 of the wall plate 10 are threadably attached to the threads 32 of extension fastener 30 whose threads 34 are rotatably attached to the treads 32 of the adjacent extension fastener 30. For purposes of this disclosure, "male threads" are those on the exterior of a shaft and "female threads" are those on the interior of a fastener with a cavity defined within and by the innermost extremity of the threads. Finally, the threads 34 of extension fastener 30 are rotatably attached to an interconnection point 50 which is either a fastener region 50 having a threaded interior or a threaded shaft, the interconnection point 50 forming a unitary piece with a wall plate 52 adapted for abutting a wall. By using a greater or smaller number of extension fasteners and/or by varying the length of extension fasteners used, space 60 between a toilet 66 (abutting toilet plate 10) and wall 80 (abutting wall plate 52) may be traversed by the adjustable spacer device 90. Once in place, the fasteners 30 are adjusted to apply positive pressure between a wall 80 and toilet tank 64, preventing shearing or lateral forces against the toilet tank 64 from causing the tank 64 to move. Further, the adhesive surface 54, 56 forms a cushion to protect the wall 80 and toilet 66 during longitudinal adjustment and ensures stabilization throughout the assembly.

In a method of using the adjustable spacer device 90 of the invention, one places the toilet insert 10 between the toilet lid 62 and a toilet tank 64, an elongated side of the toilet plate 10 is positioned against the toilet tank 64. The length of the extension mechanism is adjustable, such that a length of the adjustable spacer 90 is substantially equal to the distance from the toilet tank 64 to a wall 80, abuts the wall plate 52 against a wall 80, and secures the continuous module formation 70 under the cover 72. In a variation on this method, one may abut an elongated toilet plate 10 against a toilet tank 64, rotatably adjust a length of the adjustable spacer 90 by way of at least one threaded fastener 30 situated between the toilet plate 10 and a wall plate 52, and to attach the wall plate 52 to a wall 80.

The above method may have a step of placing a toilet insert 12 between a lid 62 of the toilet and said toilet tank 64, wherein the toilet insert 12 forms a unitary piece with said toilet plate 10. The toilet insert 12 may be at an acute or right angle with the toilet plate 10. The toilet plate 10 itself may have a breakaway joint 18 between an upper 14 and lower portion 20 thereof, this joint 18 being broken by hand before abutting the elongated plate 10 against the toilet tank 64, such that only the lower portion 20 of the toilet plate 10 is used and abutted to the exterior of the tank 64 of the toilet.

Each extension fastener 30 consists of a shaft with external or male threads 32 and a head 38 with internal or female threads 34. The head 38 of the extension fastener(s) 30 is generally formed having a multi-faceted exterior having multiple flat surfaces 36. For example, the exterior can have a square or four-faceted shape, as in FIG. 2 or a hexagon or six-faceted configuration, as for example in FIG. 6. Other designs of the multi-faceted exterior are also contemplated. For optimal performance, the wall piece 52 and extension fastener(s) 30 are loosely assembled, forming a continuous module 70, prior to insertion in the space between the toilet tank and the wall (see FIG. 3). Once pre-assembled, the module 70 is inserted into the space 60 and properly positioned. Then, the extension fastener(s) 30 are longitudinally adjusted by means of rotation to stabilize the spacer mechanism 90 and to prevent any undesirable motion of the toilet tank 64 relative to the wall 80. Once in the final position, the flat exterior surfaces 36 of the fasteners are lined up/aligned with each other (where multiple fasteners are provided) and with the flat exterior surfaces of the plate fastener 21. In this manner a continuous multi-faceted unit is formed, wherein the flat exterior surfaces are aligned, so that each flat surface of one element is positioned in the same plane with corresponding surface(s) of other element(s).

The adjustable spacer mechanism 90 may also include a cover 72, which is configured to fit over the exterior of the module 70 and the exterior of other elements, once it is formed and in place within the space 60 between the wall 80 and the toilet tank 64. In one embodiment of the invention, the cover 72 is connected to the lower portion 20 of the toilet plate 10 and is constructed with breakaway joints 74, having similar characteristics as the breakaway joint 18 between the plate upper 14 and lower portions 20 described herein. In another embodiment, the cover 72 is independent of the toilet plate. The cover 72 has an inner surface 76 formed with at least two continuous flat surfaces 82. In another embodiment, the cover 72 is provided with the inner surface, which is generally cylindrical or any other similar shape and is formed with at least two flat surfaces 82. The cover flat surfaces 82 are configured to engage the exterior flat surface(s) 36 of the extension fastener(s) 30, and/or a fastener head 55 of the wall piece 52, and/or the exterior of the element 22 of the toilet tank plate 10.

The cover 72 is made of a resilient material and includes a longitudinal slit 78 therethrough. During installation, the cover 72 is positioned on the continuous module 70 through the slit 78, so as to snap or tightly fit over its exterior. In the assembled position, the inner flat surfaces 82 of the cover engage the exterior flat surfaces 36 of the extension fastener(s) 30 and other elements of the device, thereby retaining the continuous formation of the module 70. The cover 72 is sized to match the length and geometric nature of the continuous formation of the module 70 by breaking away the excess length at the appropriate breakaway joint 74. In addition to providing an aesthetically pleasing surface, the cover 72 serves to retain the adjusted position of the continuous formation of the module 70 and other elements, and more specifically retains the alignment of extension fastener(s) 30.

The cover 72 prevents the fasteners 30 from shifting position and stabilizes the space by fitting tightly over the bolt head(s) once in the adjusted positions similar to that of a clamp. The cover 72 prevents longitudinal movement by stabilizing the position of the expansion fastener(s) 30 relative to the wall 80. The cover 72 can be formed as one unitary member or can be formed of multiple sections to facilitate installation and provide flexibility of application to match the various lengths of the final continuous formation 70.

Figure 2:
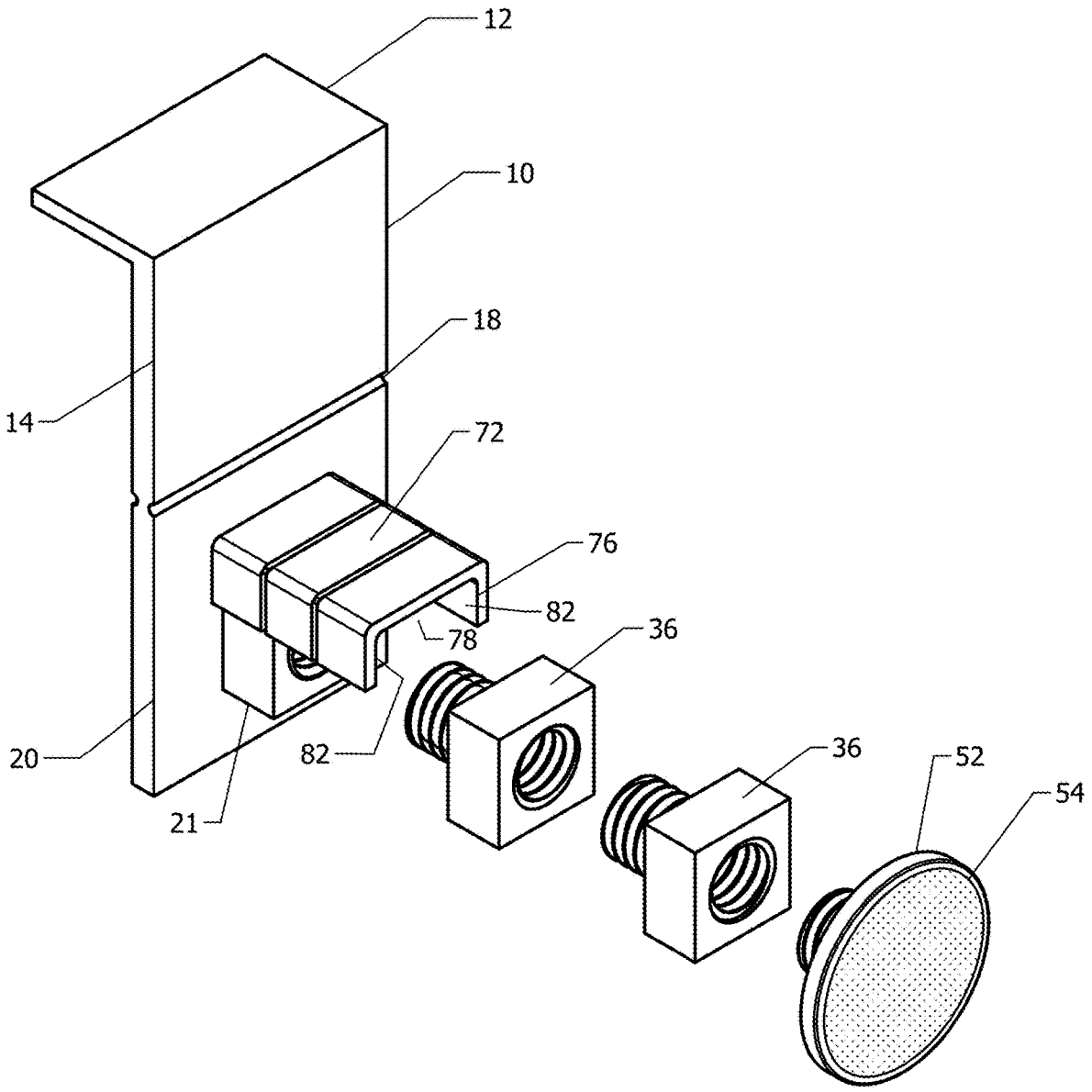
FIG. 2 is a perspective view of the spacer device of FIG. 1.

FIG. 2 shows a perspective view of the spacer device of FIG. 1. From this angle, one can see the toilet plate 10 with upper portion 14, lower portion 20, and breakaway joint 18. The breakaway joint 18 is an optional portion of the adjustable spacer 90. That is, in another embodiment, there is no thinner area between the upper 14 and lower 20 portions of the wall plate 10, or the wall plate 10 has only a continuous lower portion 20 without an upper portion 14. A breakaway joint 18 is defined as a narrower region, with respect to a plane of the wall plate 10, which allows a person to readily (without tools) bend or break from the upper portion 14 and the lower portion 20. This can be compared to the rest of the plate 10 which, in embodiments, is fixed (not breakaway) in that the rest will not readily bend or break (which, unless defective, requires tools to do so). That is, the attachment joint is a weak point which is first to break when bending the wall plate 10. Still referring to FIG. 2, each fastener 30 has a threaded inner hollow region 34 adapted for receiving external threads or another attachment mechanism. The cover 72 is also shown.

Figure 3:
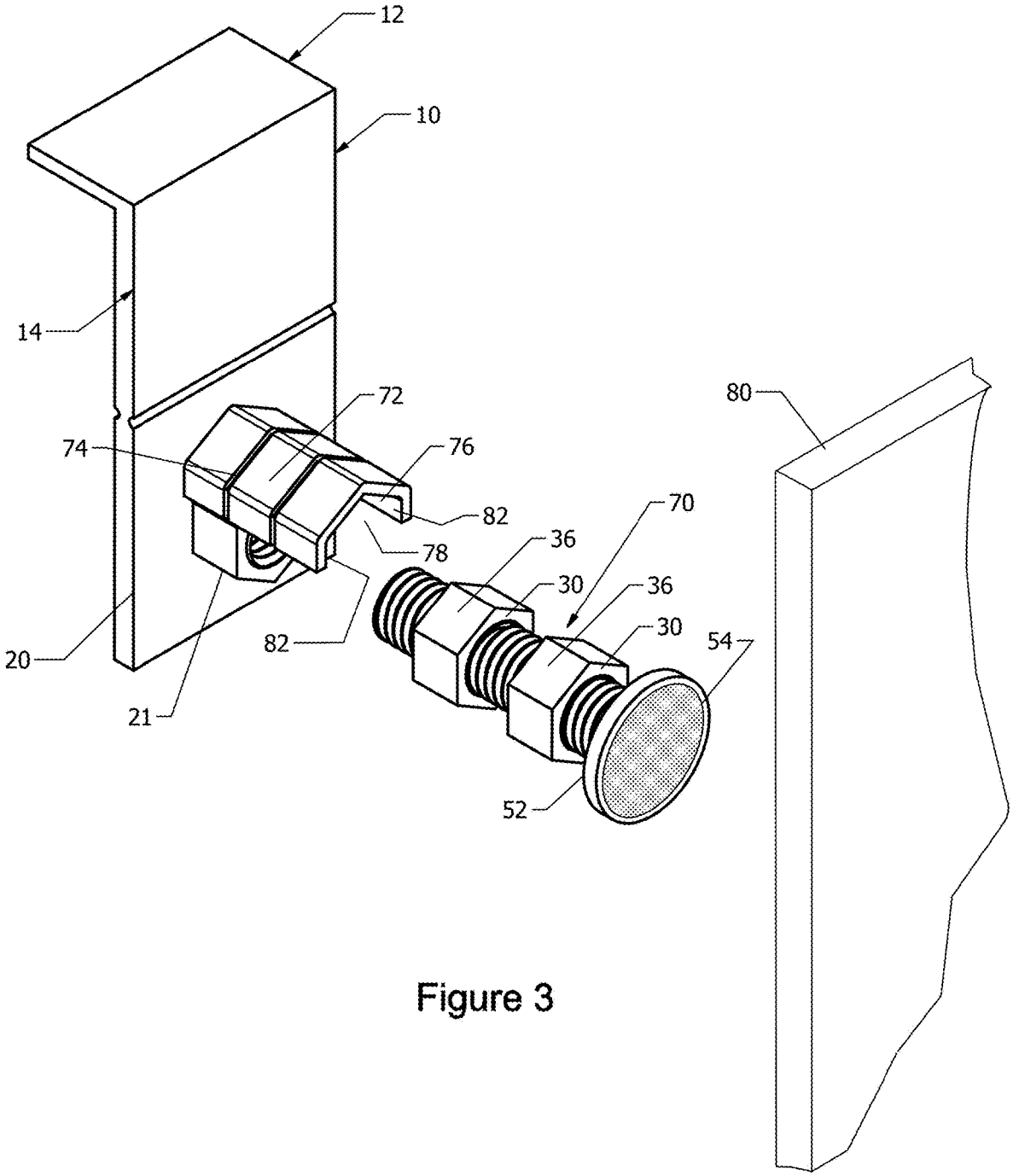
FIG. 3 is a perspective view of an adjustable spacer having hexagonal features with the continuous hexagonal module preassembled for insertion within the toilet plate.

FIG. 3 shows a perspective view of the spacer device and cover. The wall plate 52 and extension fasteners 30 are preassembled prior to installation within the space 60 and connection to the toilet plate interconnecting portion 21. Once the components are assembled, the preassembled module structure 70 is installed between the wall 80 and the toilet 66. The exteriors of the extension fasteners 30 and the connected interconnection portion 21 are hexagonally configured. The interior of the cover 72 is configured to accommodate these hexagonally shaped elements, so the cover inner flat surfaces 82, cover slit 78 and cover inner surface 76 secure the hexagonal flat surfaces 36 and 21 therewithin. The preassembled module structure 70 is formed prior to insertion in the space 60 between the wall 80 and the toilet 66. Once the preassembled structure 70 is positioned within the space 60, and a final rotated adjustment (either to expand or retract) is carried out, the entire assembly is secured and stabilized by placement of the cover 72.

Figure 4:
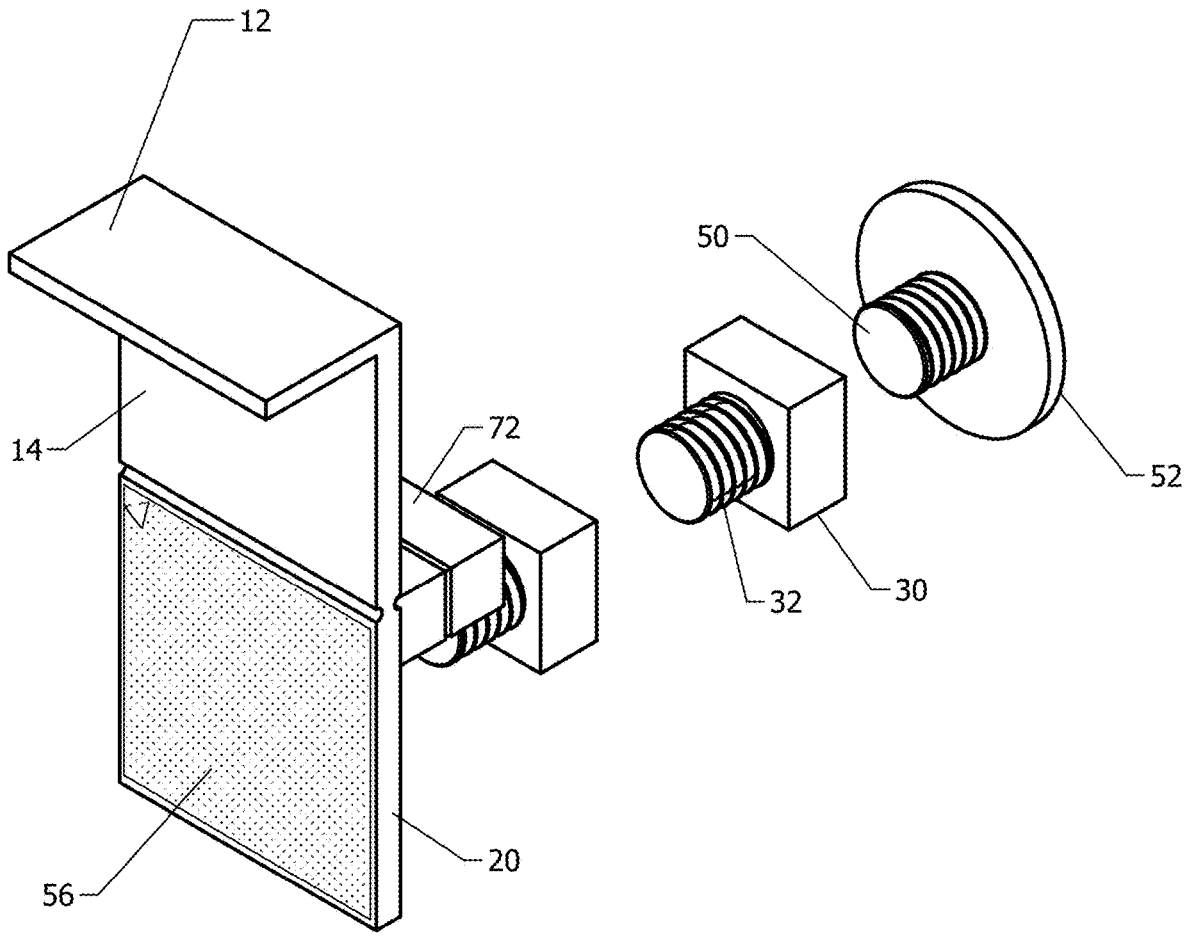
FIG. 4 is a reverse perspective view of the spacer of FIG. 1.

FIG. 4 shows a partial perspective view of the spacer device and cover of FIG. 1. While the wall plate 52 is shown as circular and having a mathematical diameter greater than that of the fasteners and less than that of the shortest dimension of the toilet plate 10, any size wall plate 52 may be used. A rear elongated side of the toilet plate 10 and a front side of the wall plate 52 faces the viewer. in these pictures. The elongated sides, for purposes of this disclosure, are those which are generally (95% or more) planar or flat and have a ratio of height to width of less than 8.

Figure 5:
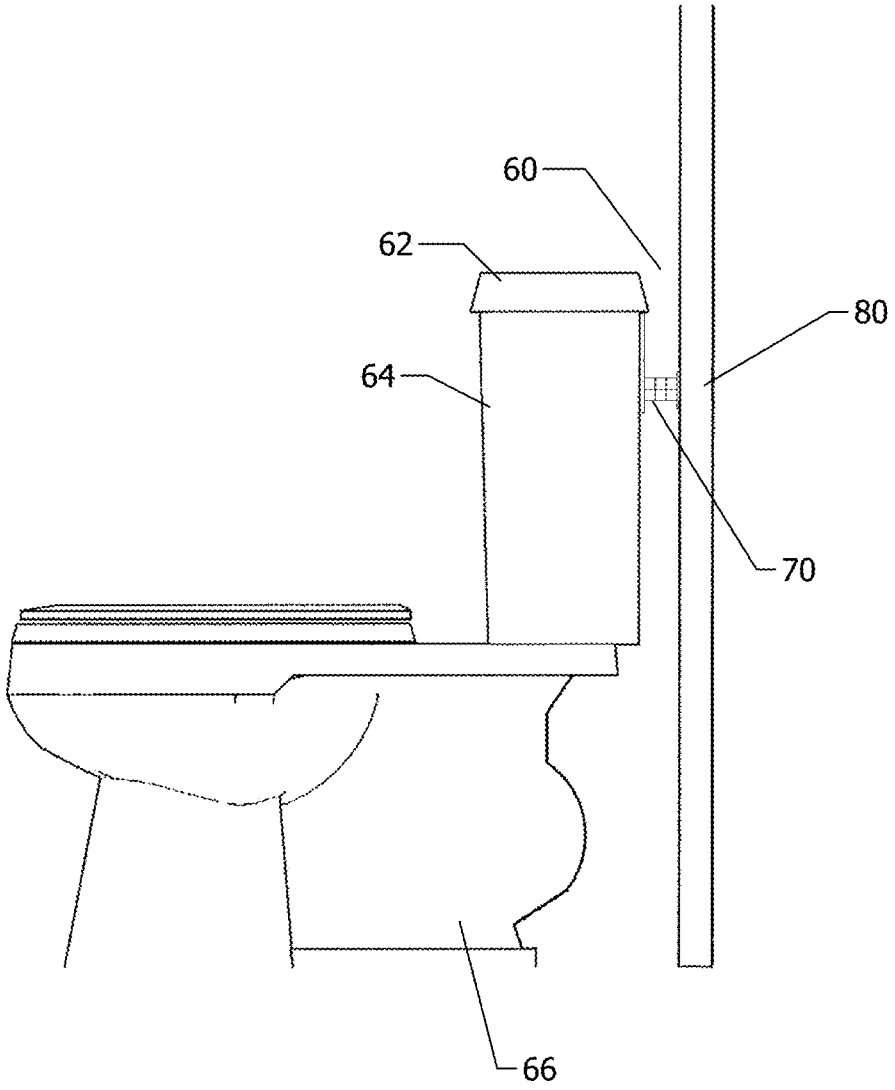
FIG. 5 is a side elevation view of the fully assembled spacer in use between a toilet and wall.
Figure 6:
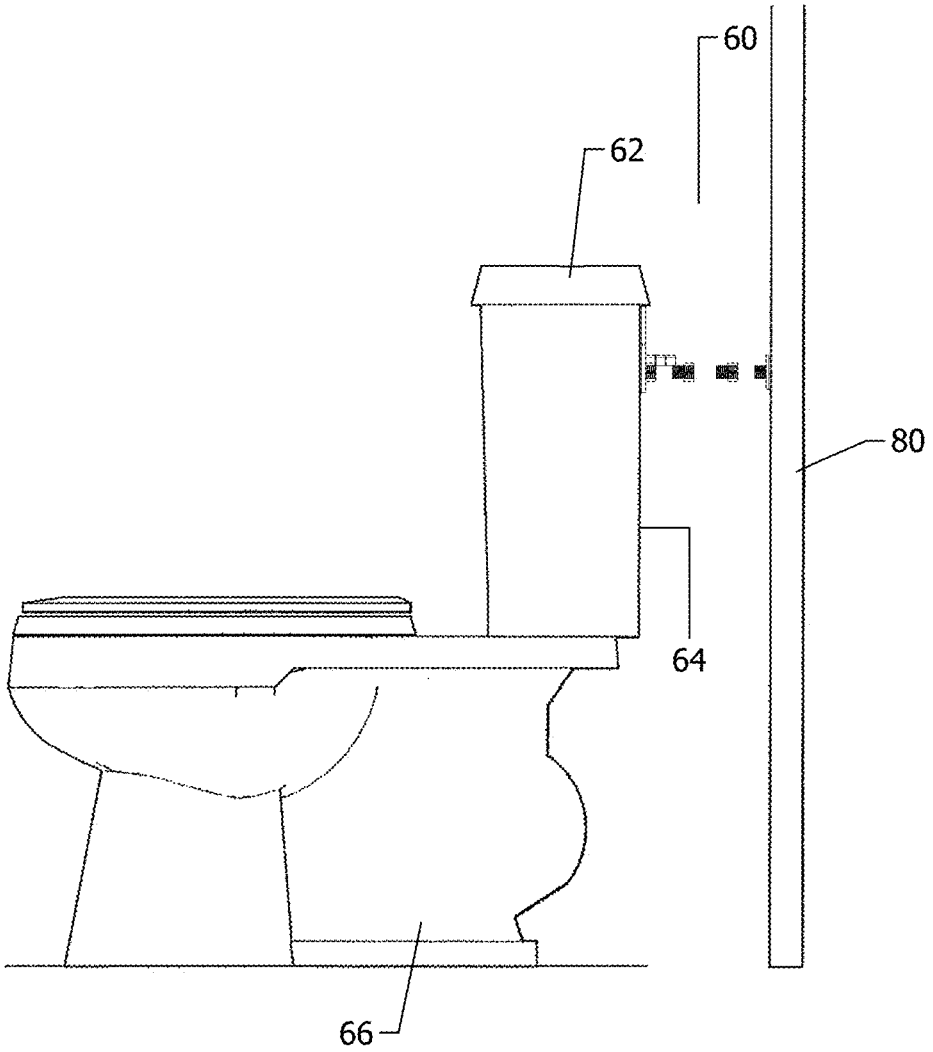
FIG. 6 is a side elevation view of a blown apart version of the spacer between a toilet and wall.

FIG. 5 is a side elevation views of the spacer device 90 in the assembled condition within the space 60 between a toilet 64 and wall 80. FIG. 6 shows a side elevation view of an exploded version of the spacer 90 between a toilet 64 and wall 80. The wall 80 is a vertical or substantially vertical rise. "Substantially," for purposes of this disclosure, is within a 5 degree or 1.5% tolerance, whichever is greater.

The toilet 66 has a tank 64, which the adjustable spacer 90 presses against, while, at the same time, pressing against the wall 80. This prevents the toilet tank 64 from moving towards the wall 80, possibly causing cracking or breaking. This is the most common direction of movement known which causes the tank 64 to crack or break as people lean themselves or other items into the toilet, especially during use thereof. The adjustable spacer device 90 acts as a wedge, preventing movement of the toilet. A single adjustable spacer 90, or a plurality of spaced-apart adjustable spacers (such as two, three, or four) may be used to prevent movement of the tank 64 and maintain it in its orientation (usually vertical or substantially vertical) above the bowl or rest of the toilet 66.

The lid 62 depicted covers the tank 64 of the toilet 66. When there is no lid 64, it may be desirable to break away the top 14 of the toilet plate 10 at the breakaway joint 18 or simply use an adjustable spacer 90 which lacks the turned toilet insert 12 and optionally includes adhesive 56.

Figure 7:
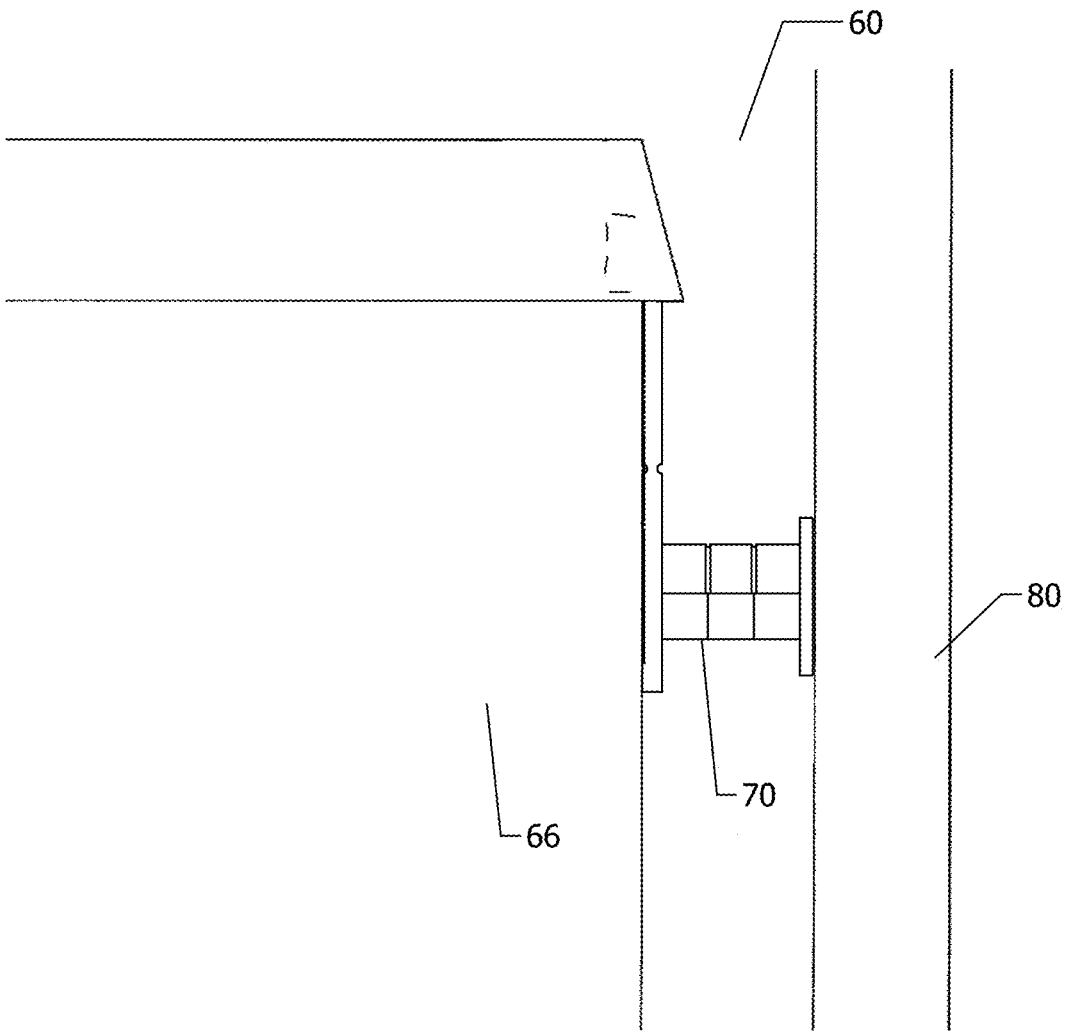
FIG. 7 is a close-up view of the adjustable spacer of FIG. 5.

FIG. 7 shows a close-up view of the adjustable spacer as a continuous formation 70 with the cover 72 interconnected thereto. Here, the toilet insert 12 is inserted between the lid 62 and toilet tank 64 of the toilet 66. The toilet plate 10 abuts the rear of the toilet 66 along the upper portion 14 and lower portion 20, with the breakaway joint 18 intact. On the other side of the adjustable spacer 90 is the wall mount 52 frictionally abutting the wall 80. Between the toilet plate 10 and wall plate 52 are extension fasteners 30 fully threaded together. In embodiments, the threads 32 are fully threaded, such that the outer fasteners (or fastener regions having cavities 34) abut each other. This is the tightest fit, such that pressure on the toilet tank 64 towards the wall 60 will not cause the fasteners 30 to tighten further as they are already tightened to the maximum.

Figure 8:
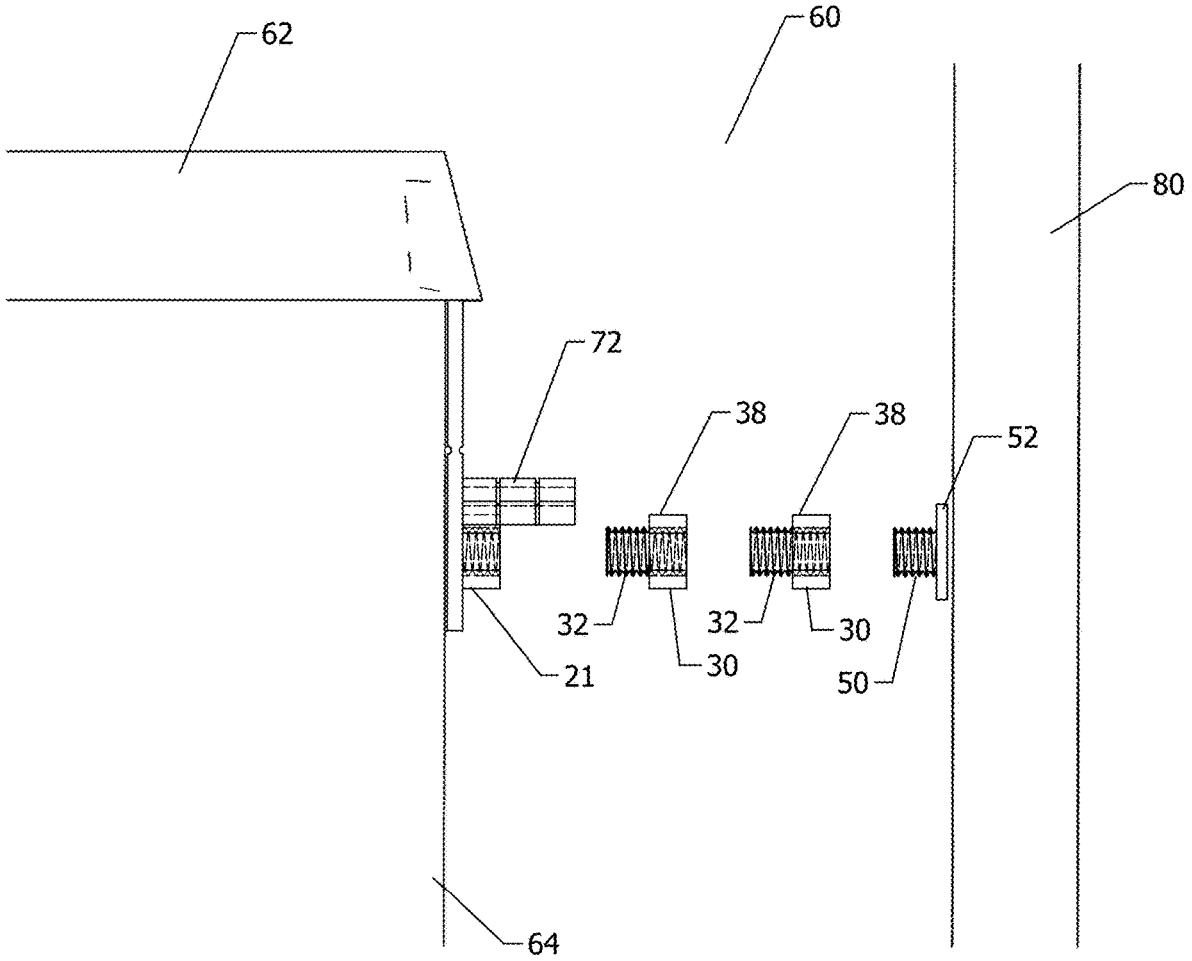
FIG. 8 is a close-up view of the adjustable spacer of FIG. 5 set between the toilet and the wall.

FIG. 8 shows a close-up view of the adjustable spacer 90 and cover. Here, one can see the position of the toilet 66 as well as the toilet plate 10 (upper portion 14; lower portion 20) having threads 22 provided to engage the extension fastener 30. The extension fastener 30 has threads 32 engaging the adjacent extension fastener 30. The extension fastener 30 has internal threads provided connect to wall plate 52 having an interconnection point 50 with external threads for threaded engagement. The wall plate 52 abuts the wall 80. Alternatively, it is within the scope of this invention that the lower portion 20 of the toilet plate includes a male shaft as the interconnecting portion 21 affixed thereto in place of a female head, whereas the wall piece 52 interconnection point 50 has a female head in place of the male shaft portion. In such an arrangement, the extension fastener(s) are reversed to threadedly interconnect with the wall piece 52 and toilet plate 10 (see FIG. 9).

Figure 9:
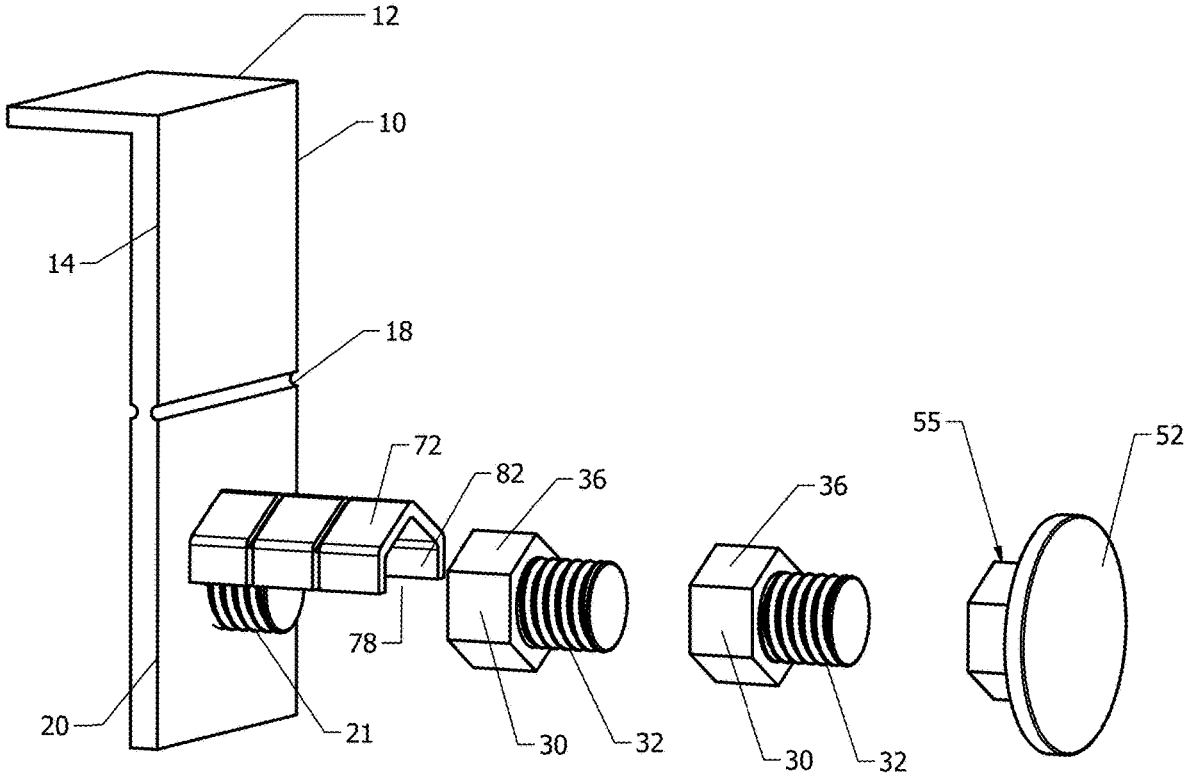
FIG. 9 is a perspective of the adjustable spacer having a hexagonal configuration and outwardly facing threaded shafts.

FIG. 9 shows a perspective view of the unassembled spacer 90 with the extension fasteners 30 and the wall plate fastener region 55 having a hexagonal exterior configuration. The connected threading 32 is in a male orientation for interconnection with the inner threading 34 of the extension fasteners 30 and the fastener region (not shown) of the wall plate. In this alternative design, the assembly and installation of the continuous structure and the module formation 70 are substantially similar to that of the other Figures having a reverse style orientation.

Figure 10:
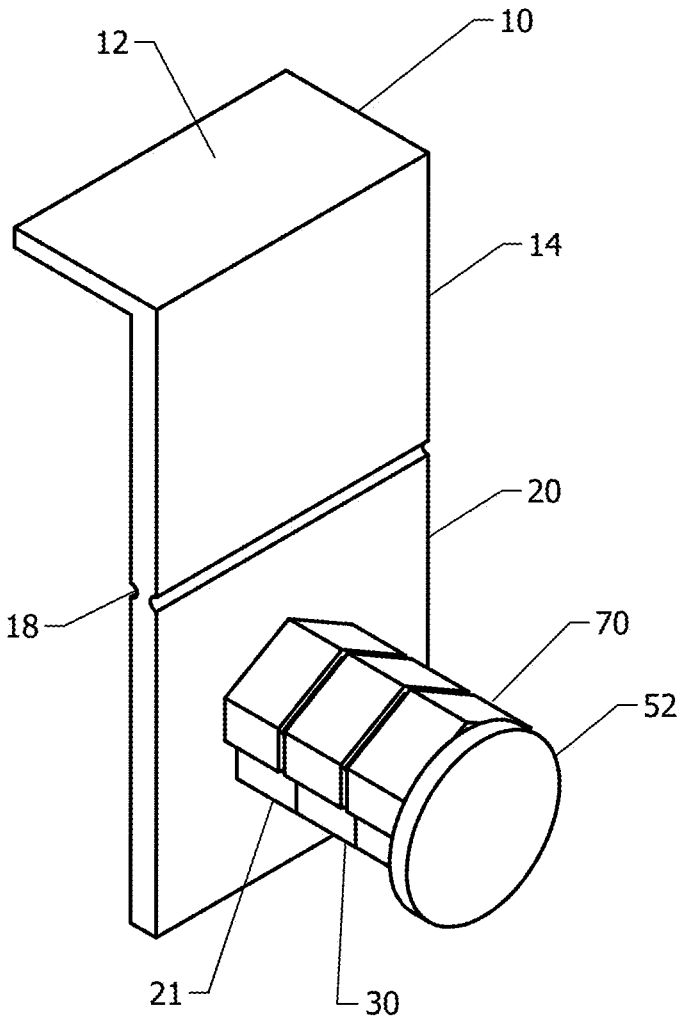
FIG. 10 is s the adjustable spacer of this invention as a continuous formation after completed installation with a hexagonal configuration.
Figure 11:
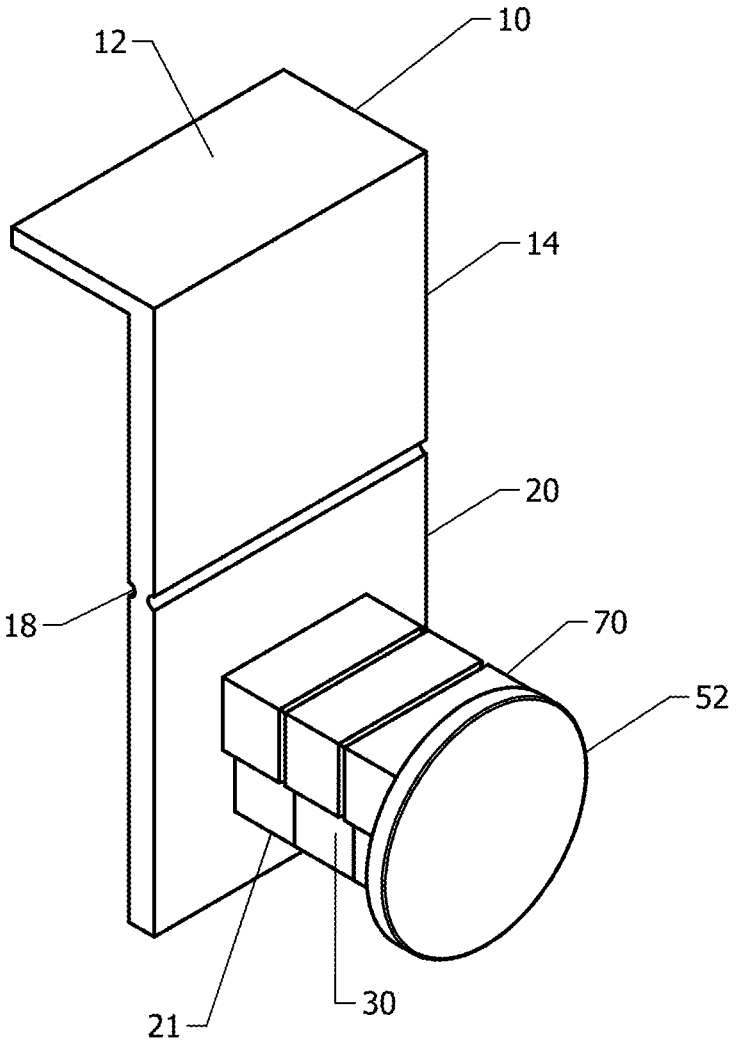
FIG. 11 is the adjustable spacer of this invention as a continuous formation after completed installation with a four-facet configuration.

FIGS. 10 and 11 show perspective views of the spacer 90 in a continuous formation 70 with the cover 72 affixed thereover. FIG. 10 shows a hexagonal configuration while FIG. 11 shows a four-facet configuration. These arrangements maintain the longitudinal configuration of the continuous formation 70, thereby providing stabilization and an aesthetically pleasing exterior surface.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

What is claimed is:

1. An adjustable spacer assembly for use within a toilet system, said toilet system consisting of at least a rear wall of a tank of a stationary toilet spaced from a stationary wall of a restroom, so that a narrow operational space is defined therebetween, said adjustable spacer comprising:

a wall plate for connection to said stationary wall, said wall plate having an interconnection point with integrated threading;

a substantially flat toilet plate connected to said rear wall of a tank of said stationary toilet, said toilet plate formed with a unitary structure having a breakaway joint set between an upper portion and a lower portion, said lower portion having an interconnecting portion with integrated threading;

a toilet insert contiguous with said upper portion and configured to be positioned between a lid of said toilet and said toilet tank, said toilet insert forming a unitary structure with said toilet plate and having an acute or right angle bend with said toilet plate;

at least one extension fastener, said extension fastener having a fastener head with a plurality of flat surfaces and internal and external threading configured for adjustable interconnection with each said extension fastener and said interconnection point threading together forming a continuous adjustable structure;

a cover positioned at said toilet plate lower portion; said cover having inner flat surfaces and a slit therethrough, said inner flat surfaces configured to house and restrict longitudinal rotation of each said extension fastener;

whereby upon rotatably interconnecting said continuous adjustable structure with said interconnecting portion and further rotatably adjusting said continuous adjustable structure along its longitudinal axis to form a continuous formation with said toilet plate and said cover and engaging said cover, said adjustable spacer is pressure affixed to said toilet tank and said wall thereby stabilizing said adjustable spacer and maintaining appropriate spacing between said toilet and said wall.

2. The adjustable spacer of claim 1, wherein the length of said adjustable spacer from said toilet plate to said wall plate is determined by rotation of said extension fastener within said continuous formation.

3. The adjustable spacer of claim 2, wherein said length of said adjustable spacer is calibrated to be the length between a toilet bowl and a wall, and said at least one extension fastener comprises multiple extension fasteners.

4. The adjustable spacer of claim 3, wherein said interconnection portion and each said extension fastener includes a six sided exterior region formed by a plurality of flat surfaces positioned at an angle to each other in a hexagonal fashion, wherein each extension fastener is rotated and interconnected until a continuous six sided structure is formed by the exterior of each said extension fastener exterior and said exterior of the interconnection portion, with said exterior flat surfaces of the interconnection portion being aligned with and continuously extending along the flat surfaces of each said extension fastener.

5. The adjustable spacer of claim 4, wherein said continuous six-sided structure extends through said entire space between said wall plate and said toilet plate.

6. The adjustable spacer of claim 5, wherein said wall plate further comprises a peel and stick adhesive affixed to the side opposite said interconnection point, said adhesive configured for attachment to said wall.

7. The adjustable spacer of claim 6, wherein said toilet plate lower portion further comprises a peel and stick adhesive affixed to the side opposite said interconnecting portion, said adhesive configured for attachment to said toilet tank, said cover having breakaway joints.

8. The adjustable spacer of claim 3, wherein said interconnection portion and each said extension fastener includes a four sided exterior region formed by a plurality of flat surfaces positioned at an angle to each other in a square fashion, wherein each extension fastener is rotated and interconnected until a continuous four-sided structure is formed by the exterior of each said extension fastener exterior and said exterior of the interconnection portion, with said exterior flat surfaces of the interconnection portion being aligned with and continuously extending along the flat surfaces of each said extension fastener; whereby said continuous four-sided structure extends through said entire space between said wall plate and said toilet plate.

* * * * *